United States Patent [101]

Cole

[11] 4,052,771

[45] Oct. 11, 1977

[54] CUFF LINKING DEVICE

[76] Inventor: Cody Jack Cole, 6200 W. Bellfort, Apt. 257, Houston, Tex. 77035

[21] Appl. No.: 693,722

[22] Filed: June 7, 1976

[51] Int. Cl.[2] ..... A44B 1/18; A44B 1/34

[52] U.S. Cl. ..... 24/102 SL; 24/102 FC; 24/102 E; 24/104; 24/47

[58] Field of Search ..... 24/102 SL, 102 R, 102 FC, 24/102 E, 104, 41, 47

[56] References Cited

U.S. PATENT DOCUMENTS

| | | | |
|---|---|---|---|
| 1,431,629 | 10/1922 | Butler | 24/102 E |
| 1,436,204 | 11/1922 | Guthrie | 24/102 E |
| 1,462,332 | 7/1923 | Fried | 24/102 SL |
| 2,510,988 | 6/1950 | Lewis | 24/102 E |
| 2,847,744 | 8/1958 | Benton | 24/102 R |
| 3,902,197 | 9/1975 | Ferretti | 24/113 MP |

FOREIGN PATENT DOCUMENTS

| | | | |
|---|---|---|---|
| 23,706 | 4/1906 | Austria | 24/102 FC |
| 213,497 | 4/1924 | United Kingdom | 24/102 E |
| 426,835 | 4/1935 | United Kingdom | 24/102 SL |
| 739,986 | 11/1955 | United Kingdom | 24/102 SL |

*Primary Examiner*—Bernard A. Gelak

[57] ABSTRACT

The cuff linking device is an implement attached to the cuff of garments such as: shirts, blouses, jackets and similar apparel, giving the garment a desirable distinctive look and provide the wearer with comfort and freedom of wrist movement. The cuff linking device is designed to fit on: conventional button style cuffs, covering the button, on button style cuffs when the button has become detached, and on french style cuffs. The cuff linking device is composed of two ornamental buttons connected by a length of chain which is securely fastened to one of the buttons at one end and having a releasable fastener at the other end. The other button is recessed to allow it to cover a conventional sewn-on button and has a stud protruding from it to which the releasable fastener is attached.

1 Claim, 5 Drawing Figures

CUFF LINKING DEVICE

OBJECTS OF THE INVENTION

One object of the present invention is to provide a means of imparting a desirable distinctive look to conventional garments such as: shirts, blouses, jackets and similar apparel.

Another object of the invention is to provide a means for covering a conventional sewn-on button.

A third object of the invention is to provide a means to utilize a garment even though the sewn-on button has become detached.

A fourth object of the invention is to provide the user of the invention with comfort and freedom of wrist movement.

SUMMARY OF THE INVENTION

The above objects are achieved in the present invention by providing a cuff linking device which consists of two ornamental buttons connected by a length of chain which is securely attached to one of the buttons by means of an eyelet, said eyelet having a retaining element, and a releasable fastener attached at the opposite end of the chain. The other button is recessed so that it may be used to cover a conventional sewn-on button and has a stud protruding from it to which the releasable fastener may be attached.

DESCRIPTION OF DRAWING FIGURES

In the accompanying drawing which forms a part of the present application:

DETAILED DESCRIPTION OF THE INVENTION

Figure 1:
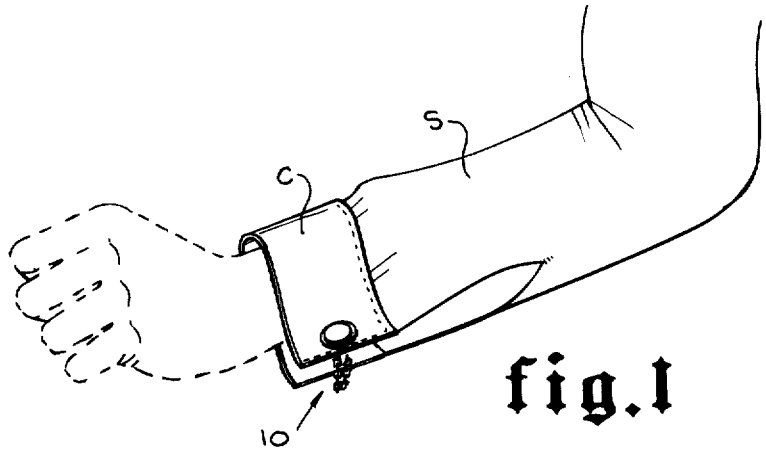
FIG. 1 is a perspective view of the cuff linking device shown being worn on a conventional button type shirt sleeve.

FIG. 1 is a perspective view of the cuff linking device 10, shown assembled on a cuff C of a shirt S.

Figure 2:
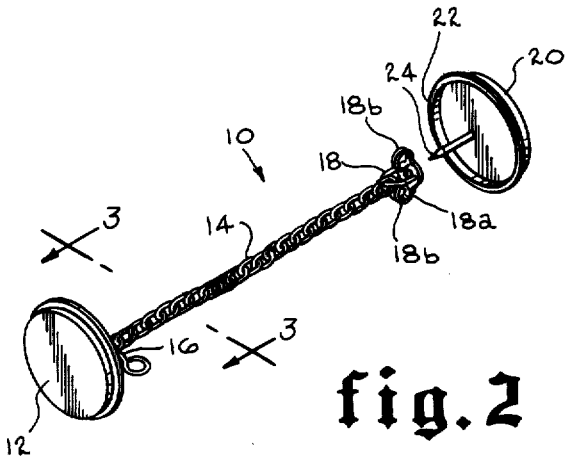
FIG. 2 is a perspective view of the cuff linking device showing the recessed button unattached.

FIG. 2 is a perspective view of the cuff linking device 10. It shows a disc shaped button 12 to which is attached a length of jewelry chain 14 by means of an eyelet 16. The opposite end of the chain 14 is attached to a releasable fastener 18. The releasable fastener 18 has a hole **18*a* in the center and two retaining elements 18*b*. Also shown in FIG. 2 is a recessed button 20 having an annular recess 22. In the center of the recessed button 20 is a stud 24 to which the releasable fastener 18** will be attached.

Figure 3:
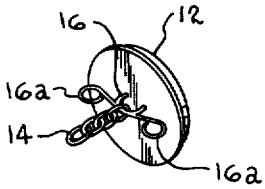
FIG. 3 is a perspective view of a portion of the cuff linking device taken along section 3—3 of FIG. 2 showing the button which is securely attached to the chain by means of an eyelet.

FIG. 3 shows the disc shaped button 12 with a length of chain 14 attached by means of an eyelet 16 which has two retaining elements **16*a* designed to secure the button 12** onto a conventional button hole.

Figure 4:
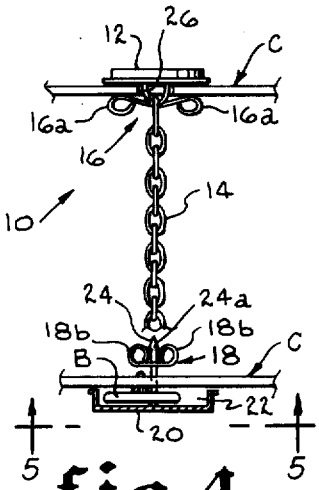
FIG. 4 is a side elevation view showing the cuff linking device assembled on a conventional sewn button cuff. The chain has been broken for clarity.

FIG. 4 illustrates how the cuff linking device 10 is attached to a conventional button and button hole cuff C. The conventional cuff C having a button hole 26 and a sewn-on button B. The chain 14 has been broken near the releasable fastener 18 and the recessed button 20 is shown in section for clarity of understanding and illustrating the concept.

To assemble the cuff linking device 10 the cuff C, the releasable fastener 18 and the chain 14 is fed through button hole 26. The eyelet 16 is maneuvered through the button hole 26 and placed in a position so that the retaining elements **16*a* prevent the button 12 and chain 14 from slipping back through the button hole 26. The recessed button 20 having stud member 24 is inserted through one of the holes of a conventional sewn-on button B and the cuff C. When the recessed button 20 is correctly in place, the recess 22 will cover the conventional sewn-on button B. The releasable fastener 18 is pressed onto the stud member 24 so that retaining elements 18*b* will grip the stud 24 providing sufficient friction so that the recessed button 20 will not come off under normal usage. The stud member 24 may also have a slightly length diameter 24*a* just beyond the point to further secure the releasable fastener 18**.

Figure 5:
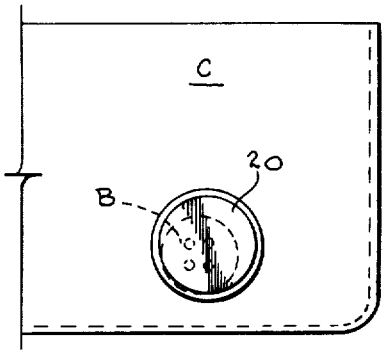
FIG. 5 is a top plan view of the cuff linking device showing the recessed button covering a sewn-on button.

FIG. 5 is a top plan view illustrating how the recessed button 20 covers a conventional sewn-on button B.

The foregoing description illustrates one form of the invention and it should be evident that the ornamental appearance of the basic elements may be modified for manufacturing or aesthetic purposes. It should be further understood that the cuff linking device may be used on a garment where the sewn-on button has become detached or on many other cuff designs which may not have buttons, such as french cuffs, and on cuffs which may have a plurality of buttons and would require more than one pair of the cuff linking devices.

What is claimed is:

1. A cuff linking device composed of a disc shaped member to which is attached one end of a length of jewelry chain by means of an eyelet, said eyelet having outwardly extending flexible retaining members, said members having a loop formed at the ends thereof, and the other end of said jewelry chain securely attached to a clasping member having a hole therein to receive a stud member, said clasping device having loops formed thereon for frictionally gripping said stud member, and a second disc shaped member having an outer side identical in appearance to the first disc shaped member and the inner side being sufficiently recessed to enclose and cover an existing button, said recess having a stud member securely attached therein and extending outwardly to a length sufficient to penetrate a hole in an existing button, the underlying fabric material, and the hole and looped ends of said clasping member.

* * * * *